United States Patent [19]

Stahlecker

[11] Patent Number: 4,459,800

[45] Date of Patent: Jul. 17, 1984

[54] METHOD OF FEEDING INDIVIDUAL FIBERS TO A SPINNING ROTOR AND DEVICE FOR CARRYING OUT THE METHOD

[75] Inventor: Fritz Stahlecker, Josef-Neidhart-Strasse 18, Bad Überkinger, Fed. Rep. of Germany

[73] Assignees: Hans Stahlecker; Fritz Stahlecker, both of Fed. Rep. of Germany

[21] Appl. No.: 376,032

[22] Filed: May 7, 1982

[30] Foreign Application Priority Data

May 26, 1981 [DE] Fed. Rep. of Germany ..... 3120877

[51] Int. Cl.[3] ..... D01H 1/12; D01H 7/892

[52] U.S. Cl. ..... 57/411; 57/413

[58] Field of Search ..... 57/400, 408, 411, 413

[56] References Cited

U.S. PATENT DOCUMENTS

| | | | |
|---|---|---|---|
| 3,763,641 | 10/1973 | Doudlebsky et al. | 57/411 X |
| 3,797,218 | 3/1974 | Landwehrkamp et al. | 57/411 |
| 3,922,839 | 12/1975 | Sakurai | 57/411 |
| 4,142,356 | 3/1979 | Husges et al. | 57/411 X |
| 4,249,370 | 2/1981 | Vecera et al. | 57/411 X |
| 4,314,440 | 2/1982 | Onoue et al. | 57/411 X |

*Primary Examiner*—Donald Watkins

*Attorney, Agent, or Firm*—Craig & Burns

[57] ABSTRACT

A method and apparatus for open-end spinning in which fibers are fed to the spinning rotor in an air stream which carries the fibers along a predetermined path; at least a substantial portion of the air stream together with the fine dust particles carried thereby is removed from the predetermined path of the fibers before the fibers reach the spinning rotor.

51 Claims, 7 Drawing Figures

METHOD OF FEEDING INDIVIDUAL FIBERS TO A SPINNING ROTOR AND DEVICE FOR CARRYING OUT THE METHOD

The present invention relates to a method for feeding individual fibers from an opening device to a spinning rotor of an open-end spinning device, in which the fibers are seized at the opening device by a transporting air stream and are taken along in the direction toward the spinning rotor, and also relates to an apparatus for carrying out the method.

In the open-end rotor spinning, the fibers are fed from an opening device, preferably an opening roller, to a spinning rotor by means of a fiber-carrying or transporting air stream produced by vacuum. The vacuum is thereby produced either by pumping holes in the spinning rotor or in that the spinning rotor is accommodated in a housing connected to a vacuum source. The transporting air, sucked in by the vacuum source, which enters into the spinning rotor by way of the fiber feed channel, leaves the same by way of bores of the spinning rotor or by way of the open rim of the rotor. The separation of the fibers from the transporting air stream takes place in the prior art device inside of the spinning rotor.

It is a known problem in connection with the open-end rotor spinning that contaminants or impurities reaching the spinning rotor together with the fibers interfere with the spinning process and lead to a decrease in the yarn quality or also to a yarn breakage. It is possible to separate the coarser and more heavy contaminants within the area of the opening roller by means of a cleaning device. However, more fine dirt particles and, in particular, dust cannot be separated out by means of such prior art cleaning devices, so that the fine particles then reach the spinning rotor together with the fibers. These finer dirt particles are only partly bound or wound up in the resulting yarn. The remainder thereof deposits itself inside of the spinning rotor and leads to changes, on the one hand, at the slide surface, along which the fibers are fed, and, on the other, at the collecting groove, whence the conditions existing for the formation of the yarn are changed. This soiling of the spinning rotor makes it necessary to preventively clean the spinning rotors in predetermined time intervals in order that a yarn quality is assured which remains as constant as possible.

The present invention is concerned with the task to provide a method for feeding fibers to a spinning rotor, by means of which the deposit of fine dirt particles in the spinning rotor is avoided.

The underlying problems are solved according to the present invention in that the fibers, prior to their entry into the spinning rotor, are separated at least from a part of the transporting air stream and the part of the transporting air stream which is thus freed from the fibers, is branched off or drawn off prior to reaching the spinning rotor. It is achieved by this method of the present invention that practically only the fibers are fed to the spinning rotor because the significantly lighter, finer dirt particles are separated together with the partial transporting air stream from the fibers and are led off and carried away. Especially in conjunction with a preceding cleaning action within the area of the opening roller, the soiling of the spinning rotors can be far-reachingly avoided so that considerably longer time intervals than possible heretofore can be established for a preventive cleaning of the spinning rotors without impairing the yarn quality.

It has also been discovered surprisingly as an additional advantage of the present invention that the spinning aggregate is contaminated to a lesser extent by fly within the area of the sliver feed, especially at the lap plate. This is apparently based on the larger rate of air flow within the area of the opening roller since, with the application of the present invention, the air quantity is not limited by the discharge cross-section of a fiber feed channel projecting into the spinning rotor.

These and other objects, features and advantages of the present invention will become more apparent from the following description when taken in connection with the accompanying drawing which shows, for purposes of illustration only, several embodiments in accordance with the present invention, and wherein.

Figure 1:
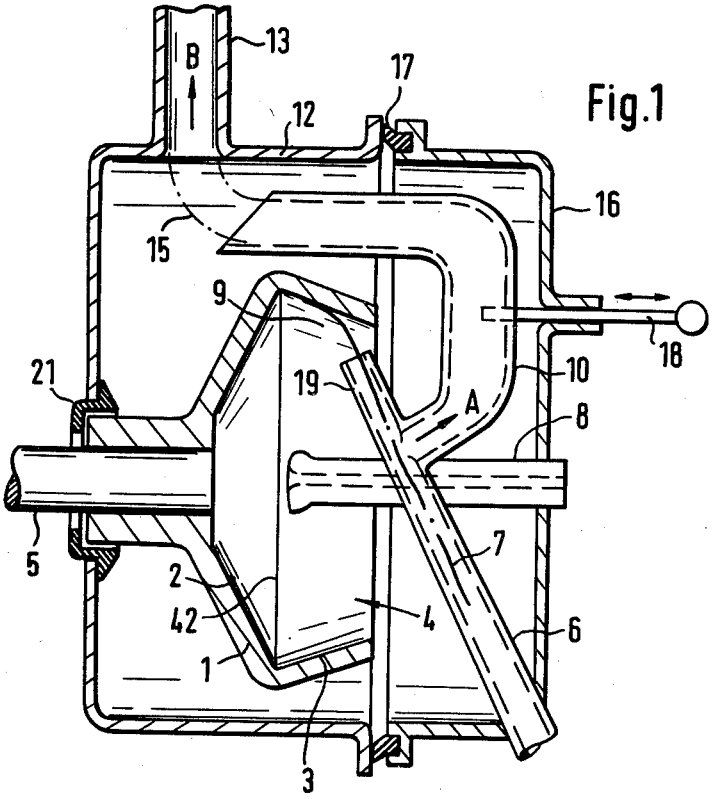
FIG. 1 is an axial cross-sectional view through a device, operating according to the method of the present invention, with a suction line connected to a fiber feed channel for drawing off the transporting air stream.

Referring now to the drawing wherein like reference numerals are used throughout the various views to designated like parts, the open-end spinning aggregate illustrated in FIG. 1 includes a spinning rotor 1 which includes a closed bottom 2 that becomes wider conically shaped and a side wall 3 adjoining the bottom 2 that tapers conically shaped in the direction toward an open end face 4. A fiber-collecting groove 42 is formed between the bottom 2 and the side wall 3. Individual fibers 7 are fed to the spinning rotor 1 by way of a fiber-feed channel 6, which reach a slide surface 9 formed by the side wall 3, along which they reach slidingly or rollingly the fiber-collecting groove 42 by reason of the centrifugal forces acting on the same. The fibers 7 deposited in the fiber-collecting groove 42 are spun into a yarn and are taken off by way of a yarn take-off channel 8 projecting into the spinning rotor 1 from the open end face 4 thereof. The spinning rotor 1 is arranged inside of a housing 12 whose back wall is provided with a bore, through which the shaft 5 of the spinning rotor 1 is extended outside of the housing 12, where it is supported and driven by any suitable known means. The bore of the back wall is sealed off by a sealing insert 21.

The housing 12 is subdivided approximately within the area of the open end face 4 of the spinning rotor 1. The upper housing part 16 disposed outside of the spinning rotor 1 is movable away from the housing 12 in a conventional manner, not illustrated in detail, for opening up and exposing the spinning rotor 1. This upper housing part 16 carries the fiber feed channel 6 and the yarn take-off channel 8. The housing 12 is additionally provided with a connection 13 for a vacuum source.

A suction line 10 is connected to the fiber feed channel 6 shortly upstream of its end at an angle of about 90°, while the beginning of the suction line 10 is located within the area of the connection 13 for the vacuum source. As will be explained hereinafter in detail, this suction line 10 may also be connected directly with the vacuum connection 13 by way of a fixed elbow 15 as indicated in dash-and-dotted lines. A transporting air stream adapted to carry along fibers is produced by means of the vacuum prevailing in the fiber feed channel 6, which takes off the fibers 7 from an opening roller and transports or carries the same in the direction toward the spinning rotor 1. In order to achieve to the greatest possible extent that the transporting air stream itself does not enter the spinning rotor 1, it is sucked off prior to reaching the spinning rotor 1 by way of the suction line 10. As a result thereof, a separation of the largest portion of the transporting air stream from the fibers 7 takes place outside of the spinning rotor 1 since the fibers 7, which by reason of their mass possess a relatively high kinetic energy, continue to fly rectilinearly downstream of the suction place up to the spinning rotor 1. In contrast thereto, the transporting air, for the most part, leaves the fiber feed channel 6 together with such particles as are considerably more light-weight than the fibers 7 and, above all, also possess a greater suspendability or floating ability, already at the place where it is sucked off. It is achieved thereby that in particular the fine dust taken along by the transporting air stream is sucked off before it reaches the spinning rotor 1 so that it cannot deposit itself thereat.

In order to attain a completely satisfactory fiber guidance, it is appropriate if the connection of the suction line 10 does not have a larger spacing with respect to the slide surface 9 of the spinning rotor 1 than corresponds to half the staple length of the fed fiber material. In order to be able to suck off the transporting air stream as completely as possible, it is appropriate if the suction line 10 is connected to the fiber feed channel 6 with a cross-section that corresponds at least to twice the cross-section of the fiber feed channel 6 at this location. As a result thereof, the adjoining portion 19 of the fiber feed channel 6 which protrudes into the spinning rotor 1, only acts as mechanical guide means that further determines the feed direction of the fibers 7.

Since the spinning rotor 1, by reason of its high rotational speed, forms within the area of the discharge of the fiber feed channel 6, a zone of somewhat smaller vacuum, the proportion of the air sucked through the adjoining portion 19 is relatively small. This proportion can be further reduced if the suction line is directly connected to the vacuum connection 13 by way of an elbow 15. It is thereby also possible to meter this air flow in that an opening with a predetermined cross section is provided between the connection 13 and the housing 12, for example, within the area of the elbow 15, which permits only a certain air quantity to be sucked off with the predetermined vacuum.

Generally speaking, the vacuum produced by the spinning rotor 1 by reason of its centrifugal action suffices to suck back a yarn end through the yarn take-off channel 8 for the purpose of the spinning start. However, if the start of the spinning is to be facilitated, a closure element may be provided in the suction line 10, for example, a slide valve 18 which is accessible from the outside and which can be actuated during the start of spinning in order to interrupt the suction by way of the suction line 10 during the spinning start. The slide member 18 is then again opened after the spinning start operation so that transporting air can be sucked off corresponding to arrow A and can be conducted away corresponding to the arrow B by way of the connection 13.

Figure 2:
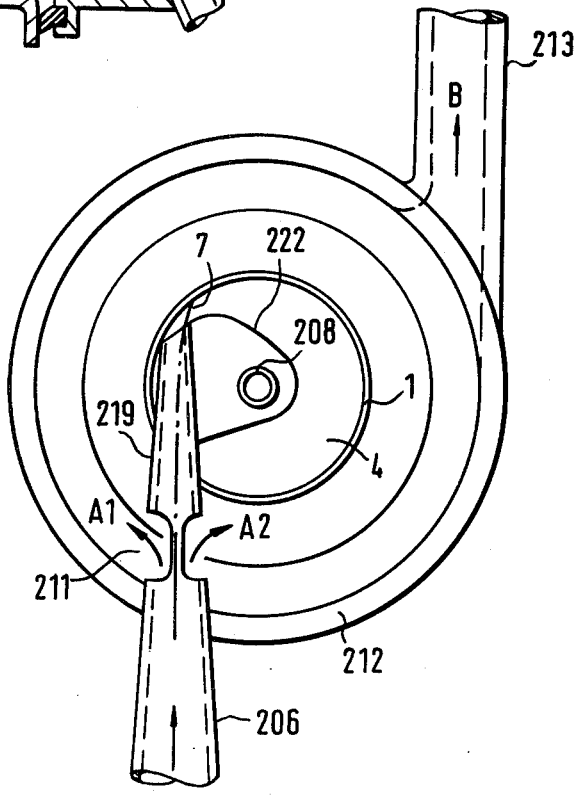
FIG. 2 is a plan view on a modified embodiment of an opened open-end spinning device in accordance with the present invention with a fiber feed channel that is provided with suction openings upstream of the spinning rotor.

In the embodiment according to FIG. 2, a spinning rotor 1 is arranged inside of a housing 212 whose upper part has been omitted for reasons of simplicity; a fiber feed channel 206 and a yarn take-off channel 208 project into the open end face 4 of the spinning rotor 1. The housing 212 is provided with a connection 213 for a vacuum source, directed tangentially to the spinning rotor 1. The fiber feed channel 206 is provided outside of the spinning rotor 1 with openings 211 of large area, by way of which the transporting air flowing-in together with the fibers 7, can be sucked off far-reachingly corresponding to the arrows $A_1$ and $A_2$, by means of which the fibers 7 are transported from an opening device (not shown) to the spinning rotor 1. The fibers 7 continue to fly rectilinearly by reason of their mass inertia and are conducted by the part 219 into the interior of the spinning rotor 1.

In this embodiment, the fiber feed channel 206, properly speaking, terminates outside of the spinning rotor 1 and is extended up to the spinning rotor 1 only a tubularly shaped guide means 219 continuing the contour of the fiber feed channel 206. The fiber feed channel 206 together with the guide means 219 is connected with the yarn take-off channel 208 by way of a connecting part 222. These parts are supported in a manner not illustrated in detail by an upper housing part which may be constructed, for example, corresponding to the embodiment of FIG. 1. Also in this embodiment, the fine contaminants, together with the branched-off transporting air, leaves the fiber feed channel 206 within the area of the apertures 211 so that practically only the fibers 7 are still fed to the spinning rotor 1. A considerable reduction of the soiling of the spinning rotor 1 also can be attained thereby. The transporting air expands within the area of the apertures 211 and thus essentially loses also immediately its velocity whereas the fibers 7 essentially maintain their velocity and are continued to be conducted on to the spinning rotor 1.

Figure 3:
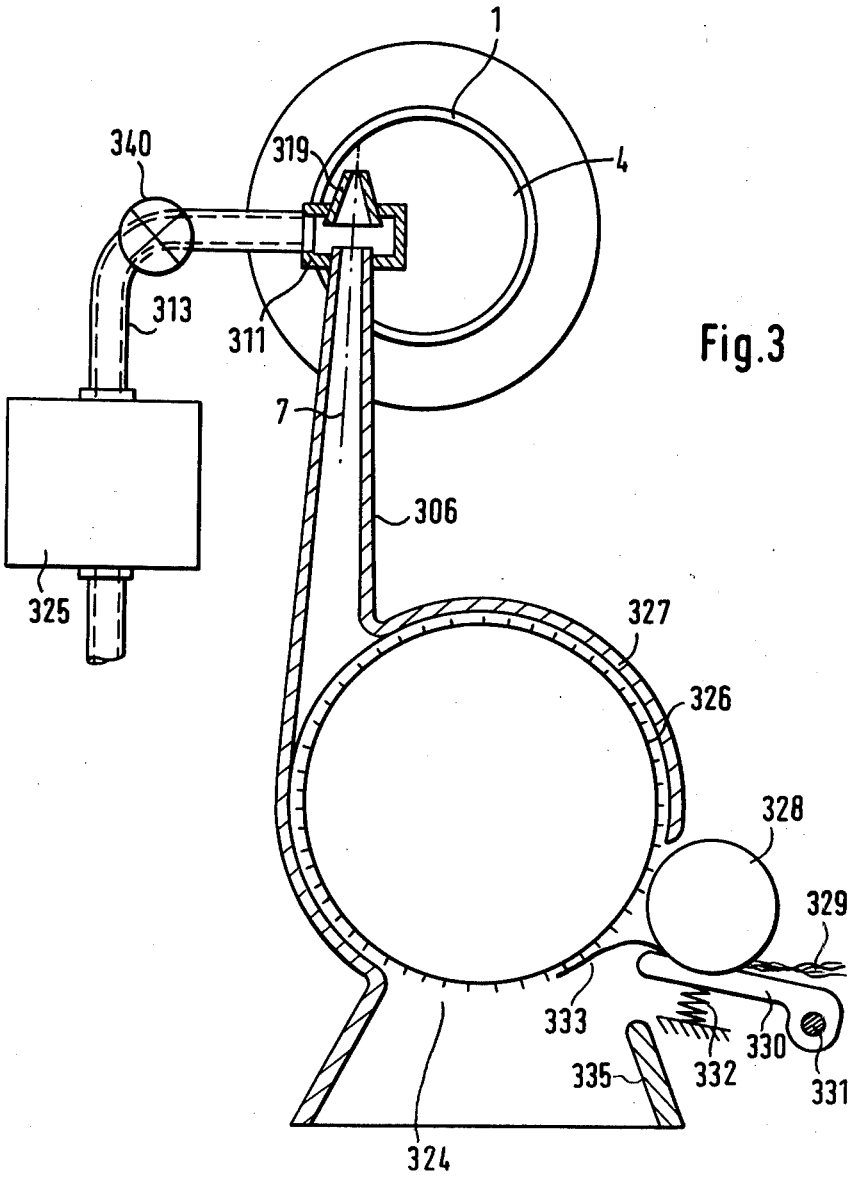
FIG. 3 is a somewhat schematic view, partially in cross-section, of a further embodiment of the present invention with a direct suction connection at the end of the fiber feed channel and with a guide means continuing the feed of the fibers.

In the embodiment according to FIG. 3, an opening roller 326 is schematically illustrated, to which a sliver 329 is fed by means of a feed device that is formed by a dished lever 330 pivotal about a shaft 331 and by a feed roller 328 against which the lever 330 is spring-loaded by means of a spring 332. The fiber tuft 333, still held by the feed device, is carded out by the opening roller 326 whereby the coarser contaminants are separated out within the area of the separating opening 324 delimited by the guide surfaces 335. Above all, those contaminants are separated which have a smaller suspension capability than the fibers.

The opening roller 326 which is arranged in a housing 327 produces by its rotation an air flow rotating about the same which takes along in the transporting or feeding direction the individual fibers, as well as also the fine dirt particles and, in particular, dust. These fibers 7 and the dirt particles are fed to a spinning rotor 1 by way of a fiber feed channel 306 starting approximately tangentially at the opening roller 326. The transport of the fibers 7 in the fiber feed channel 306 is effected by means of an air stream produced by vacuum.

A suction device 311 is connected to the end of the fiber feed channel 306 within the area of the spinning rotor 1, which is in communication by way of a line 313 with a vacuum source (not shown). The suction device 311 is provided in extension of the rectilinear fiber feed channel 306 with a funnel-shaped tapering guide means 319 whose discharge cross section is matched to the yarn count to be spun and which projects into the inside of the spinning rotor 1 and is directed against a slide wall of the rotor 1. The inlet cross-section of the funnel-shaped guide means 319 is larger than the outlet cross-section of the fiber feed channel 306 so that all fibers 7 which, by reason of their kinetic energy, reach the spinning rotor 1, are additionally compressed or bundled together. The transporting air loses its velocity by reason of the cross-sectional enlargement inside of the suction device 311 and is far-reachingly sucked off transversely to the transport direction of the fibers 7. The light-weight contaminants are also sucked off together with this transporting air stream, especially fine dust which has a higher suspension ability than the fibers 7.

If the spinning rotor 1 is not arranged in a housing under vacuum, then an air stream is sucked in also by the guide means 319 which is directed opposite the transporting direction of the fibers 7 and, above all, also opposite the flight direction of the dust. This air flow can be so metered by a corresponding cross-sectional dimensioning of the guide means 319 that it does not disturb the fiber transport, yet carries off the dust with certainty. It is thereby particularly advantageous that the guide means 319 very strongly bundles or compresses the in-flowing fibers 7 and is able to feed the same to the spinning rotor in a highly controlled, orderly manner.

In the embodiment of FIG. 3, it is also indicated that a collecting tank 325 for dust may be arranged in the suction line 313, which is provided appropriately with a filter to be exchanged from time-to-time.

If the spinning rotor 1 is arranged in the embodiment according to FIG. 3 within a housing that is connected to a vacuum source, then it can also be attained that a slight air stream still passes through the guide means 319 in the transporting direction of the fibers 7. The same effect can also be achieved if a conventional spinning rotor 1 is used that is provided with pumping holes and which produces during operation a vacuum on its inside. For the spinning start operation, it may be appropriate if the suction effect is turned off while the yarn end is brought back. A closure valve 340 may be provided for that purpose in the line 313.

The direct connection of the suction line 313 to the fiber feed channel makes possible an increased rate of air flow. This rate of air flow is not limited by the discharge cross section of the guide means 319. The contamination of the spinning aggregate with fly within the area of the feed roller 328 and of the dished lever 330 is reduced by the increased rate of air flow within the fiber feed channel 306.

Figure 4:
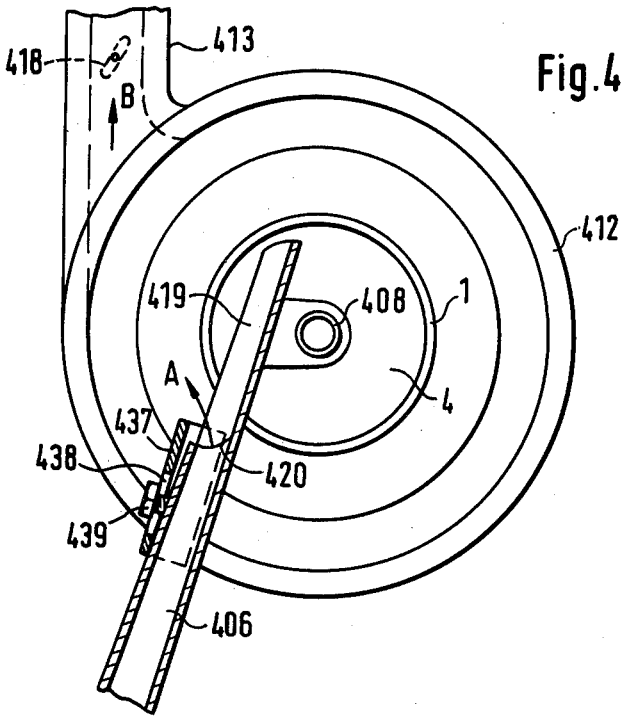
FIG. 4 is a plan view, partially in cross section, through a still further embodiment of the present invention with a fiber feed channel terminating outside of the spinning rotor and continued by a guide means.
Figure 5:
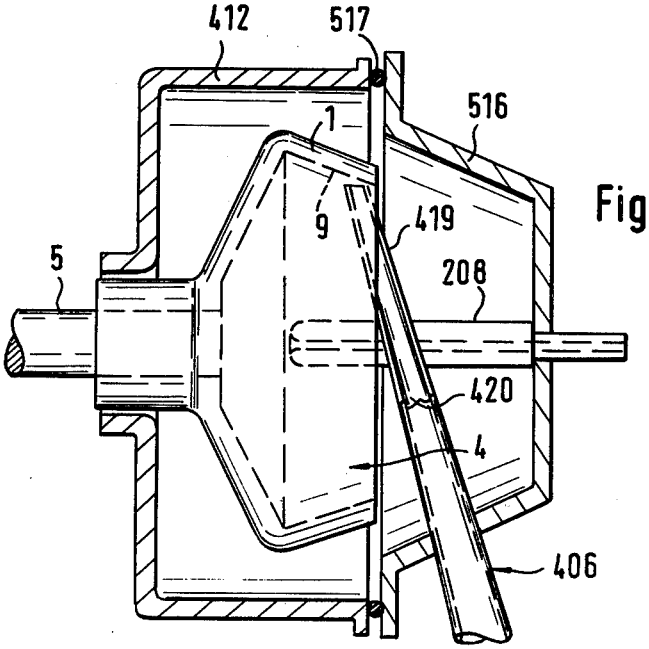
FIG. 5 is a somewhat schematic, axial cross-sectional view of the embodiment of FIG. 4.

The embodiment according to FIGS. 4 and 5 in its construction in principle corresponds far-reachingly to the embodiment according to FIG. 2. Also, in this embodiment a fiber feed channel 406 is provided between an opening device (not shown) and a spinning rotor 1 arranged concentrically in a housing 412. The housing 412 is provided with a connection 413 for a vacuum source that is directed approximately tangentially to the spinning rotor 1.

The fiber feed channel 406 terminates outside of the spinning rotor 1. It is extended by a guide means 419 made in one piece with the fiber feed channel 406, which guide means has an approximately semicylindrical or U-shaped cross-section and commences at the discharge 420 of the fiber feed channel 406. The open side of the guide means 419 faces the side wall of the spinning rotor 1 so that the closed side faces the yarn take-off channel 408 and therewith the axis of rotation of the spinning rotor 1. The guide means 419 extends into the open end face 4 of the spinning rotor 1 and is disposed opposite a slide wall 9 of the spinning rotor 1. Appropriately, the connection 413 for the vacuum source is disposed adjacent the open side of the guide means 419 and of the discharge 420 of the fiber feed channel 406 so that a direct air flow is obtained in the direction of the arrow A toward the connection 413, by way of which the transporting air of the fibers is far-reachingly sucked off directly corresponding to the direction of arrow B prior to reaching the spinning rotor 1.

Also, in this embodiment, it is appropriate if the location of the discharge 420 of the fiber feed channel 406 is matched to the length of the fiber material to be processed, to which is also matched normally the spinning rotor, particularly as regards its diameter. If the housing upper part 516 that accommodates the fiber feed channel 406, the guide means 419 and the yarn take-off channel 208 is not constructed as exchangeable part, this can be realized in that a cover 437 is secured within the area of the discharge 420 of the fiber feed channel 406, which has a semicylindrical contour and which is slidably retained in the transport direction of the fiber feed channel 406 by means of a screw 439 and an elongated aperture 438 in such a manner that the discharge 420 of the fiber feed channel 406 can be displaced thereby.

In order to be able to influence the intensity of the air flow independently of the produced vacuum, an adjustable air flap 418 is provided in the illustrated embodiment inside of the connection 413.

Figure 6:
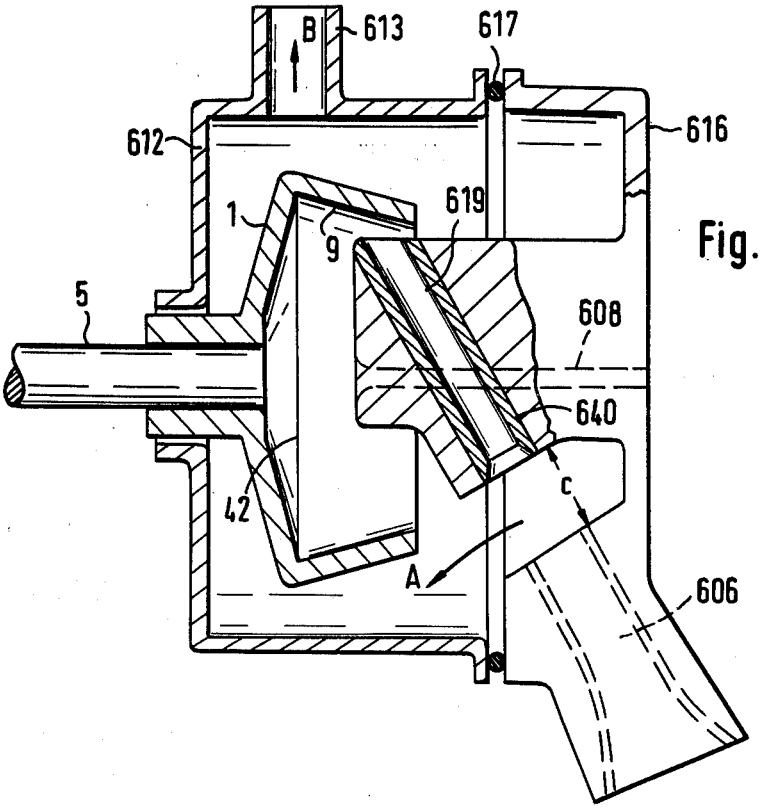
FIG. 6 is a somewhat schematic axial cross-sectional view through another embodiment of the present invention similar to FIG. 2.

In the embodiment according to FIG. 6, the spinning rotor 1 is accommodated in a housing 612 which is connected with a vacuum source (not shown) by way of a connection 613. The housing 612 is closed off by means of an upper housing part 616 by way of interposition of a sealing ring 617. The upper housing part 616 includes two projections, of which one accommodates the tapering fiber feed channel 606 and the other a tubularly shaped fiber guide means 619 of constant cross-section. The fiber feed channel 606 is separated from the tubularly shaped guide means 619 which is arranged coaxially to the fiber feed channel 606, by a large spacing c. This spacing c is located outside of the spinning rotor 1 so that the transporting air leaving the fiber feed channel 606 is led off or conducted away to the largest extent according to the arrow A prior to reaching the spinning rotor 1 and can reach the suction line along the direction of arrow B. It has been found from tests that the distance c should amount to between about 4 and about 12 mm. The fine dust particles also follow the air stream carried away according to the direction of arrow A, which dust particles have a greater suspension ability than the fibers and which thus do not reach the spinning rotor 1.

The fibers, in contrast thereto, maintain their flight direction and reach the slide wall 9 of the spinning rotor 1 through the tubularly shaped guide means 619, from where they slide or roll off into the fiber-collecting groove 42, from which they are taken off as spun yarn by way of the yarn take-off channel 608. The tubularly shaped guide means 619 whose inlet end is bevelled off funnel-shaped, is constructed as interchangeable insert 640 which can be matched both as regards the spacing of its discharge to the slide wall 9 of the spinning rotor 1 as also as regards its length and diameter to the spinning rotor 1, respectively, to the yarn count to be spun. As a result of the subdivision of the fiber feed elements into a fiber feed channel 606 and a fiber guide means 619, the additional advantage is obtained that each part can be manufactured and machined more favorably for itself.

As a result of the free zone c, two channel sections 606 and 619 result in the embodiment according to FIG. 6, whereby as large as possible an air quantity is sucked through the first channel section (fiber feed channel) 606 whereas only a slight air quantity still passes through the second channel section (guide means) 619. This arrangement assures that with constant vacuum in the fiber feed channel 606, an air quantity is attained which can be increased considerably compared to a one-piece fiber feed channel without removal of the spinning air that reaches into the spinning rotor 1. This increased air quantity is advantageous for keeping free the sliver feed elements of fiber fly. Therebeyond, it is attained that the largest part of the transporting air does not reach the spinning rotor 1 so that air turbulences are avoided thereat which might disturb the orderly deposit of the individual fibers on the slide wall 9 of the spinning rotor 1. The main advantage, however, is the removal of the fine dust, whereby it has been demonstrated in practice that already slight improvements in the actual machine are of immense importance.

As can be seen in particular from FIG. 6, the discharge orifice of the fiber feed channel 606 has a larger cross-section than the discharge orifice of the guide means 619. Since the air discharge velocity out of the discharge orifice of fiber feed channel depends only from the established pressure difference and not from the size of the orifice cross section, it becomes apparent that the air at the discharge out of the fiber feed channel 606 has practically the same velocity as with a discharge out of the orifice of a feed channel which is thought as uninterrupted, i.e., not interrupted by the free zone c. It follows therefrom that with an interrupted feed channel, a larger air velocity prevails at the place of the dischage orifice of the fiber feed channel 606 than in the case in which the feed channel is not interrupted, i.e., is continuous (in the latter case, the air velocity would be decreased by reason of the continuity equation). This again has as a consequence that with an interrupted feed channel, the air velocity is larger within the area of the opening roller than with a non-interrupted feed channel. This, in turn, leads to an improved detachment of the fibers from the opening roller and to an increased acceleration of the fibers in the air stream so that the fibers receive a larger kinetic energy and thus can overcome effortlessly the zone of interruption in the feed channel. The present invention thus combines in the preferred embodiment the advantages of the high air velocity in the area adjoining the opening roller together with the advantage of being able to use a small discharge cross section of the guide means 619 within the area of the spinning rotor 1 so that the fibers impinging onto the slide wall 9 are well bundled or compressed.

Figure 7:
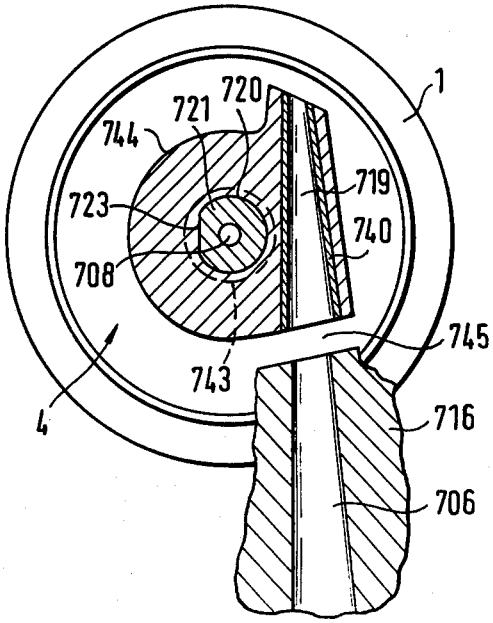
FIG. 7 is a plan view, with the cross section taken in the feed plane of the fibers, of a still further embodiment in accordance with the present invention similar to FIG. 6 and including an additional adapter ring.

The embodiment according to FIG. 7 corresponds in principle to the construction of the embodiment according to FIG. 6. The lower housing part surrounding the spinning rotor 1 has been omitted in this figure for sake of simplicity. The upper housing part 716 is shown only within the area of a fiber feed channel 706 and within the area of a projection 721 surrounding the yarn take-off channel 708. A fiber guide means 719 aligned with the fiber feed channel 706 follows the fiber feed channel 706 of the upper housing part 716, leaving a free zone 745, which fiber guide means 719 is directed toward a slide wall of the spinning rotor 1 and tapers conically. This guide means 719 is provided with an interchangeable tube 740. Therebeyond, the entire fiber guide means 719 is constructed as interchangeable structural part and is secured at the upper housing part 716. The upper housing part 716 includes the already mentioned projection 721 coaxial to the yarn take-off channel 708, over which is mounted the fiber guide means 719 by means of a corresponding bore. In order to avoid assembly errors and to assure an exact positioning, the bore 720 and the projection 721 are appropriately profiled, for example, by the presence of a corresponding centering surface 723. The fiber guide means 719 is secured on the projection 721 by a yarn take-off nozzle 743 which, in turn, is also constructed as interchangeable structural part and is screwed into the projection 721 in such a manner that it is aligned with the yarn take-off channel 708.

The fiber guide means 719 is constructed within the area outside of the tubular member 740 as a ring or cylinder concentric to the yarn take-off channel 708, as so-called adapter ring 744 whose outer diameter can be matched to the inner diameter of the spinning rotor 1 by exchanging the fiber guide means 719.

While I have shown and described several embodiments in accordance with the present invention, it is understood that the same is not limited thereto but is susceptible of numerous changes and modifications as known to those skilled in the art, and I therefore do not wish to be limited to the details shown and described herein, but intend to cover all such changes and modifications as are encompassed by the scope of the appended claims.

I claim:

1. A method for feeding individual fibers from an opening device to a spinning rotor of an open-end spinning unit, in which fibers are seized at the opening device by a transporting air stream and are taken along in the direction toward the rotor, comprising the steps of:

(a) separting the fibers transported by the air stream from the opening device to the spinning rotor prior to their entry into the spinning rotor at least from a portion of the transporting air stream at a place intermediate the opening device and the spinning rotor, and (b) bleeding off the portion of the transporting air stream freed of the fibers prior to reaching the spinning rotor.

2. A method according to claim 1, further comprising the step of guidingly conducting the fibers after the separation from the portion of the transporting air stream.

3. An apparatus for feeding individual fibers from an opening means to a spinning rotor means of an open-end spinning device, in which fibers are seized at the opening means by a fiber-carrying air stream and are taken along in the direction toward the spinning rotor means, characterized by further means at a location intermediate the opening means and the spinning rotor means for separating the fibers prior to their entry into the spinning rotor means at least from a portion of the fiber-carrying air stream and for bleeding off the part of the air stream freed from the fibers prior to reaching the spinning rotor means.

4. An aapparatus according to claim 3, characterized in that the further means includes guide means for continuing to conduct the fibers after separation from the portion of the air stream.

5. An apparatus according to claim 3, in which the opening means is connected with the spinning rotor means by way of a fiber feed channel means in which the fiber-carrying air stream is adapted to be produced by means of a vacuum source, characterized in that a suction channel means is connected to the fiber feed channel means shortly upstream of its spinning-rotor end at an angle to the fiber-carrying direction of the fibers.

6. An apparatus according to claim 5, characterized in that the suction channel means is connected to the fiber feed channel means at an angle of approximately 90° transversely to the transporting direction of the fibers.

7. An apparatus according to claim 6, characterized in that the fiber feed channel means is essentially rectilinear.

8. An apparatus according to claim 5, 6 or 7, characterized in that the connection cross section of the suction channel means amounts to at least twice the cross-section of the fiber feed channel means at this location.

9. An apparatus according to claim 8, characterized in that the connection for the suction channel means at the fiber feed channel means is provided at a distance from the place of impingement of the fibers on a slide wall of the spinning rotor means, which distance is smaller than half the fiber length of the fiber material to be processed.

10. An apparatus according to claim 9, characterized in that the suction channel means is disposed with its start opposite a vacuum connection of a housing means enclosing the spinning rotor means.

11. An apparatus according to claim 10, characterized in that the vacuum connection is open also with respect to the housing means surrounding the spinning rotor means.

12. An apparatus according to claim 11, characterized in that a closure means is arranged in the suction channel means operable to control the exhaust to the vacuum source.

13. An apparatus according to claim 12, characterized in that the control means meters the suction in the suction channel means.

14. An apparatus according to claim 12, characterized in that the control means is operable to close off the suction in the suction channel means.

15. An apparatus according to claim 12, characterized in that the suction channel means is a component part of an upper housing part detachable from the housing means, said upper housing part accommodating the fiber feed channel means and a yarn take-off channel means.

16. An apparatus according to claim 5, 6 or 7, characterized in that the connection for the suction channel means at the fiber feed channel means is provided at a distance from the place of impingement of the fibers on a slide wall of the spinning rotor means, which distance is smaller than half the fiber length of the fiber material to be processed.

17. An apparatus according to claim 5, 6 or 7, characterized in that the suction channel means is disposed with its start opposite a vacuum connection of a housing means enclosing the spinning rotor means.

18. An apparatus according to claim 17, characterized in that the vacuum connection is open also with respect to the housing means surrounding the spinning rotor means.

19. An apparatus according to claim 5, 6 or 7, characterized in that a closure means is arranged in the suction channel means operable to control the exhaust to the vacuum source.

20. An apparatus according to claim 5, 6 or 7, characterized in that the suction channel means is a component part of an upper housing part detachable from the housing means, said upper housing part accommodating the fiber feed channel means and a yarn take-off channel means.

21. An apparatus according to claim 3, with a spinning rotor means which is accommodated in a housing means connected to a vacuum source, and in which the spinning rotor means is connected to an opening means by way of a fiber feed channel means, characterized in that the feed channel means is provided with suction aperture means outside of the spinning rotor means.

22. An apparatus according to claim 21, characterized in that the suction aperture means have at least twice the cross-sectional area compared to the cross-sectional area of the fiber feed channel means that follows in the transporting direction of the fibers.

23. An apparatus according to claim 21 or 22, characterized in that the distance of the suction aperture means to the impingement place of the fibers on a slide wall of the spinning rotor means is smaller than half the fiber length of the fiber material to be processed.

24. An apparatus according to claim 3, with a spinning rotor means which is accommodated in a housing means connected to a vacuum source and which is connected with an opening means by way of a fiber feed means including a fiber feed channel means, characterized in that the fiber feed channel means terminates outside of the spinning rotor means, said fiber feed channel means being effectively extended into the spinning rotor means by way of a mechanical guide means extending in the transporting direction of the fibers.

25. An apparatus according to claim 24, characterized in that the guide means has at least an approximately semicylindrical cross-section.

26. An apparatus according to claim 24, characterized in that the guide means has an approximately U-shaped cross-section 27. An apparatus according to claim 24, 25 or 26, characterized in that the guide means includes a closed side wall facing the axis of rotation of the spinning rotor means.

28. An apparatus according to claim 27, characterized in that an adjustable cover element is provided at the end of the fiber feed channel means which is slidable over the beginning of the guide means.

29. An apparatus according to claim 28, characterized in that the guide means is formed in one piece with the fiber feed channel means.

30. An apparatus according to claim 24, characterized in that an adjustable cover element is provided at the end of the fiber feed channel means which is slidable over the beginning of the guide means.

31. An apparatus according to claim 24 or 30, characterized in that the guide means is formed in one piece with the fiber feed channel means.

32. An apparatus according to claim 3, with a spinning rotor means that is connected with an opening means by way of a fiber feed means that includes a fiber feed channel means for a fiber-carrying air stream produced by vacuum, characterized in that the discharge end of the fiber feed channel means is adjoined by a suction means having a suction direction deviating from the transporting direction of the fiber feed channel means, the suction means including guide means leading to the spinning rotor means and disposed in extension of the fiber feed channel means.

33. An apparatus according to claim 32, characterized in that the inlet opening of the guide means is funnel-shaped and has a larger cross section than the discharge orifice of the fiber feed channel means.

34. An apparatus according to claim 32 or 33, characterized in that the suction means includes a collecting tank for dust and the like.

35. An apparatus according to claim 3, with a spinning rotor means which is accommodated in a housing means connected to a vacuum source and which is connected with an opening means by way of a fiber feed means including a fiber feed channel means, characterized in that the fiber feed channel means terminates outside of the spinning rotor means and in that the fiber feed channel means is followed in the transport direction of the fibers by a tubularly shaped guide means projecting into the spinning rotor means and starting at a distance from the fiber feed channel means.

36. An apparatus according to claim 35, characterized in that the distance between the end of the fiber feed channel means and the guide means amounts to about 4 to about 12 mm.

37. An apparatus according to claim 35 or 36, characterized in that the guide means is a tubularly shaped part which is detachably retained in a support means.

38. An apparatus according to claim 35 or 36, characterized in that the fiber feed channel means and the guide means are provided at an upper housing part detachable from the housing means.

39. An apparatus according to claim 37, characterized in that the discharge opening of the guide means has a smaller diameter than the discharge opening of the fiber feed channel means.

40. An apparatus according to claim 39, characterized in that the fiber guide means aligned with the fiber feed channel means is detachably secured at the upper housing part which is also provided with the fiber feed channel means.

41. An apparatus according to claim 40, characterized in that the fiber guide means is mounted by means of a bore on a projection of the upper housing part containing a yarn take-off channel means and is secured at the projection by a yarn take-off nozzle.

42. An apparatus according to claim 41, characterized in that the yarn take-off nozzle is screwed into the projection.

43. An apparatus according to claim 35, characterized in that the discharge opening of the guide means has a smaller diameter than the discharge opening of the fiber feed channel means.

44. An apparatus according to claim 38, characterized in that the fiber guide means aligned with the fiber feed channel means is detachably secured at the upper housing part which is also provided with the fiber feed channel means.

45. An apparatus according to claim 44, characterized in that the fiber guide means is mounted by means of a bore on a projection of the upper housing part containing a yarn take-off channel means and is secured at the projection by a yarn take-off nozzle.

46. An apparatus for an open-end spinning unit, in which fibers are fed by an air stream along a predetermined path to the inside of a spinning rotor, said path being substantially rectilinear at least within the area thereof terminating in the spining rotor, characterized by further means along the rectilinear part of said path in the area thereof near the spinning rotor for deflecting at least a substantial part of the air stream together with any fine dirt particles contained therein while permitting said fibers to continue along said path into the inside of the spinning rotor to thereby enable the spinning of yarn freed of at least a substantial portion of the fine dirt particles.

47. An apparatus according to claim 46, characterized in that said further means includes means for sucking off at least a substantial portion of said air stream and of said dirt particles.

48. An apparatus according to claim 46, in which said predetermined path is substantially rectilinear, characterized in that the further means deflects said portion of air stream and dirt particles from said substantially rectilinear path.

49. An apparatus according to claim 46, 47 or 48, characterized in that the further means includes guide means for guiding said fibers into said spinning rotor.

50. An apparatus according to claim 49, in which the fibers downstream of the location of deflection of the air stream part, continue along said path by the kinetic energy due to their mass.

51. An apparatus for an open-end spinning unit, in which fibers are fed by an air stream along a predetermined path from an opening device to the inside of a spinning rotor, characterized by further means along the path between the opening device and the spinning rotor and nearer the spinning rotor for removing at least a substantial part of the air stream together with any fine dirt particles contained therein while permitting said fibers to continue along said path into the inside of the spinning rotor to thereby enable the spinning of yarn freed of at least a substantial portion of the fine dirt particles.

* * * * *